US007681409B2

(12) United States Patent
Alahyari et al.

(10) Patent No.: US 7,681,409 B2
(45) Date of Patent: Mar. 23, 2010

(54) CURTAIN AIR ADMISSION ASSEMBLY

(75) Inventors: Abbas A. Alahyari, Manchester, CT (US); Mary D. Saroka, Syracuse, NY (US); Gary D. Winch, Colchester, CT (US)

(73) Assignee: Hill Phoenix, Inc., Conyers, GA (US)

( * ) Notice: Subject to any disclaimer, the term of this patent is extended or adjusted under 35 U.S.C. 154(b) by 447 days.

(21) Appl. No.: 11/661,252

(22) PCT Filed: Sep. 1, 2005

(86) PCT No.: PCT/US2005/031189

§ 371 (c)(1),
(2), (4) Date: Feb. 26, 2007

(87) PCT Pub. No.: WO2006/039043

PCT Pub. Date: Apr. 13, 2006

(65) Prior Publication Data

US 2007/0251253 A1 Nov. 1, 2007

Related U.S. Application Data

(60) Provisional application No. 60/614,954, filed on Sep. 30, 2004.

(51) Int. Cl.
*A47F 3/04* (2006.01)

(52) U.S. Cl. ..... 62/255; 62/256

(58) Field of Classification Search ..... 62/255–256
See application file for complete search history.

(56) References Cited

U.S. PATENT DOCUMENTS 3,063,252 A 11/1962 Lamb
3,125,864 A 3/1964 Ural
3,182,466 A 5/1965 Beckwith
3,229,475 A 1/1966 Balk et al.
3,230,733 A 1/1966 Rutishauser et al.

(Continued)

FOREIGN PATENT DOCUMENTS

EP 0540874 A2 5/1993

(Continued)

OTHER PUBLICATIONS

U.S. Appl. No. 10/374,640, filed Feb. 26, 2003, Alahyari et al.

(Continued)

*Primary Examiner*—William E. Tapolcai
*Assistant Examiner*—Lakiya Rogers
(74) *Attorney, Agent, or Firm*—Foley & Lardner LLP

(57) ABSTRACT

A refrigerated merchandiser includes a display case defining a product display region having an open-front isolated from the ambient air of the store by means of a downwardly directed inner air curtain of relatively cold refrigerated air and a downwardly directed outer air curtain of relatively warmer air established via an improved curtain air admission assembly. The curtain air admission assembly defines a plenum atop the refrigerated display through which the flow of air substantially reverses direction when passing from a first flow passage to a second flow passage. This reversal of flow direction serves to distribute the air flow more uniformly along the length of the display case.

27 Claims, 2 Drawing Sheets

U.S. PATENT DOCUMENTS 3,232,072 A 2/1966 Barroero
3,233,423 A 2/1966 Beckwith et al.
3,256,799 A * 6/1966 Beckwith et al. ..... 454/190
3,289,432 A 12/1966 Brennan et al.
3,304,736 A 2/1967 Brennan et al.
3,369,375 A 2/1968 Gerwerk et al.
3,444,698 A 5/1969 Lorenz
3,517,526 A 6/1970 MacMaster et al.
3,648,482 A 3/1972 Beckwith et al.
3,712,078 A 1/1973 Maynard et al.
3,771,323 A 11/1973 Simons et al.
3,812,684 A 5/1974 Brown
3,827,254 A 8/1974 MacMaster et al.
3,847,135 A 11/1974 Sherman
3,850,003 A 11/1974 Beckwith et al.
3,888,091 A 6/1975 Butts
3,937,033 A 2/1976 Beckwith et al.
4,117,698 A 10/1978 Vogel
4,144,720 A 3/1979 Subera et al.
4,267,706 A 5/1981 Abraham
4,269,037 A 5/1981 Karashima
4,326,385 A 4/1982 Ibrahim
4,414,822 A 11/1983 Ibrahim
4,449,374 A 5/1984 Ibrahim
4,457,140 A 7/1984 Rastelli
4,608,776 A 9/1986 Kooy
4,633,677 A 1/1987 Maehara
4,680,942 A 7/1987 Kooy
4,845,957 A 7/1989 Richardson
4,938,034 A 7/1990 Rosanio et al.
5,048,303 A 9/1991 Campbell et al.
5,086,627 A 2/1992 Borgen
5,138,843 A 8/1992 Tamayana et al.
5,255,530 A 10/1993 Janke
5,310,978 A 5/1994 Smith et al.
5,345,778 A 9/1994 Roberts
5,347,827 A 9/1994 Rudick et al.
5,357,762 A 10/1994 Charton
5,357,767 A * 10/1994 Roberts ..... 62/256
5,402,654 A 4/1995 Rudick et al.
5,417,079 A 5/1995 Rudick et al.
5,417,081 A 5/1995 Rudick et al.
5,502,979 A 4/1996 Renard
5,678,421 A 10/1997 Maynard et al.
5,870,898 A 2/1999 Choi
5,875,642 A 3/1999 Lee et al.
5,953,929 A 9/1999 Bauman et al.
5,966,958 A 10/1999 Maynard
6,058,722 A 5/2000 Choi
6,070,424 A 6/2000 Bauman et al.
6,112,546 A 9/2000 Kim
6,138,460 A 10/2000 Lee
6,234,894 B1 5/2001 Goracke et al.
6,257,010 B1 7/2001 Shei et al.
6,295,820 B1 10/2001 Cauchy et al.
6,351,964 B1 3/2002 Brancheau et al.
6,367,274 B1 4/2002 Mellado
6,381,976 B1 5/2002 Kempiak et al.
6,619,052 B1 9/2003 Nash, Jr.
6,672,092 B2 1/2004 Ruiz et al.
6,701,735 B1 3/2004 Daddis, Jr. et al.
6,701,736 B1 3/2004 Johnson
6,701,739 B2 3/2004 Morse
6,722,149 B1 * 4/2004 Saroka et al. ..... 62/256
6,755,042 B2 6/2004 Chuang et al.
6,775,994 B1 8/2004 Math et al.
6,923,013 B2 8/2005 Chiang et al.
6,948,324 B2 9/2005 Jin
6,955,061 B2 10/2005 Chiang et al.
6,959,560 B2 11/2005 Weikel et al.
6,973,800 B2 12/2005 Chuang et al.
7,162,882 B2 1/2007 Alahyari et al.
2004/0055321 A1 * 3/2004 Kempiak ..... 62/255
2004/0134221 A1 7/2004 Fee et al.
2004/0163401 A1 8/2004 Alahyari et al.
2007/0289323 A1 12/2007 Swofford et al.
2008/0282719 A1 11/2008 Fung

FOREIGN PATENT DOCUMENTS

GB 2011071 A 7/1979
WO WO2004/062762 A2 7/2004
WO WO2004/075694 A1 9/2004
WO WO2005/072566 A1 8/2005
WO WO 2008/051226 A1 5/2008

OTHER PUBLICATIONS

European Search Report for European Application No. 05711288, dated Aug. 27, 2007, 3 pages.
International Preliminary Report on Patentability for International Application No. PCT/US2005/000347, dated Jul. 10, 2006, 4 pages.
International Search Report and Written Opinion for International Application No. PCT/US2004/004935, dated Aug. 11, 2004, 10 pages.

* cited by examiner

CURTAIN AIR ADMISSION ASSEMBLY

CROSS REFERENCE TO RELATED APPLICATION

Reference is made to and this application claims priority from and the benefit of U.S. Provisional Application Ser. No. 60/614,954, filed Sep. 30, 2004, and entitled CURTAIN AIR ADMISSION ASSEMBLY, which application is incorporated herein in its entirety by reference.

FIELD OF THE INVENTION

The present invention relates generally air curtain admission assemblies and to refrigerated display merchandisers of the type used in supermarkets, mini-marts, convenience stores and other commercial establishments for displaying and merchandising refrigerated or frozen products for sale. More particularly, the present invention relates to open refrigerated display merchandisers of the type wherein a multi-layer air barrier is formed to separate the cold refrigerated air within the display region of the merchandiser from exposure to the ambient air outside the merchandiser by passing a plurality of air streams across the open product display region of the merchandiser.

BACKGROUND OF THE INVENTION

Refrigerated display merchandisers, also commonly referred to as display cases, having open display regions are commonly used in supermarkets, mini-marts, convenience stores and other commercial establishments for displaying and merchandising refrigerated or frozen products for sale. The open nature of such display cases permits the consumer to simply reach into the product display region to select and remove a product for purchase without the inconvenience of needing to open a door to access the product. Customarily, in open front display cases, at least a single curtain of cold refrigerated air is passed downwardly at a relatively high velocity across the open front of the display case to form an invisible barrier between the product display region and the region of the store in front of the display case. This air curtain not only helps retain cool refrigerated air within the product display region of the display case, thereby cooling the display product on the shelves of the display case, but also functions to isolate, to a certain extent, the product display region from the ambient air within the store. Ambient air that does enter into open product display region undesirably causes increased energy consumption by increasing the cooling demand on the refrigeration system associated with the display case. Further, such ambient air may also cause a local temperature rise within the product display region sufficient to result in an undesirable rise in product temperature that could adversely impact upon product quality.

A problem encountered with when passing a curtain of refrigerated air downwardly across the open front of the product display region of the display case lies in the entrainment of ambient air into the stream of refrigerated air forming the air curtain. Turbulence exists at the boundary between the relatively high velocity curtain air and the generally quiescent ambient air lying in front of the display case. As a result of such turbulence, some ambient air is undesirably entrained into the air curtain.

Multiple air curtain display cases have been developed in the prior art to address this entrainment problem. For example, display cases having two adjacent, parallel, but independently generated, air curtains of refrigerated air are common in the art. Typically, such as disclosed by Maehara in U.S. Pat. No. 4,633,677, the outermost air curtain has a slightly higher temperature than the innermost air curtain, so as to protect the colder innermost air curtain from the impact of ambient air entrainment.

Also, it is well known in the art to establish a third air curtain of relatively high temperature ambient air outwardly of one or two refrigerated air curtains as a means of reducing entrainment of ambient air from the store into the refrigerated air curtains. Abraham, in U.S. Pat. No. 4,267,706, Brown in U.S. Pat. No. 3,812,684, and MacMaster et al in U.S. Pat. No. 3,517,526, each disclose establishing an ambient air curtain outwardly of an innermost refrigerated air curtain, with the outer ambient air curtain being directed downwardly parallel to and adjacent to the inner refrigerated air curtain. Beckwith et al, in U.S. Pat. Nos. 3,648,482; 3,850,003 and 3,937,033; MacMaster et al, in U.S. Pat. No. 3,827,254 and Roberts, in U.S. Pat. Nos. 5,345,778 and 5,357,767, each disclose establishing an ambient air curtain outwardly of a pair of refrigerated air curtains. The curtain closest the product display region of the display case is coolest, while the center curtain is at a temperature slightly warmer than the innermost curtain, but substantially cooler than the outermost ambient air curtain. The center curtain of warmer refrigerated air serves to buffer the innermost colder refrigerated air curtain from warm air intrusion from the outermost ambient air curtain. The outermost curtain of ambient air is directed substantially vertically downwardly, either parallel to and adjacent the center air curtain or slightly inwardly toward the center air curtain, so as to preclude refrigerated air from the center and innermost refrigerated air curtains from spilling out of the product display region of the display case. The outermost ambient air curtain itself ideally spills into the store near the base of the display case so as to not be drawn into the air return inlets through which the refrigerated air curtains return to the evaporator compartment.

In conventional practice, the ambient air curtain is established by drawing ambient air by means of one or more fans from the store environment into a plenum located in the forward portion of the top wall of the display cabinet of the merchandiser. Then ambient air discharges from the plenum through a grid to form the air curtain. The grid serves to direct the ambient air curtain along a desired path to the outside of one or more inner curtain of cooler refrigerated air. Conventionally, the inlet duct to the plenum through which the ambient air is drawn forms a relatively short and relatively direct path through the top wall of the display cabinet. A shortcoming of an admission assembly of this type lies in the tendency of the air flow discharging through the grid to be non-uniform along the length of the display case. The resultant non-uniformity in the air curtain degrades the overall effectiveness and performance of the air curtain. Thus, although generally effective to substantially reduce the amount of entrainment of ambient air into the recycled refrigerated air as compared to a single air curtain design, significant improvement in overall air curtain effectiveness can be achieved by providing an improved ambient air admission assembly that ensures a generally uniform flow distribution in the resultant air curtain along the length of the display case.

SUMMARY OF THE INVENTION

It is an object of the invention to provide an air curtain admission assembly through which a generally more uniform flow distribution is ensured in establishing an air curtain across an opening.

It is an object of another aspect of the invention to provide a refrigerated merchandiser having an open product display region and equipped with an air curtain admission assembly through which a generally more uniform flow distribution is ensured in establishing an air curtain across the open product display region.

An air curtain admission assembly of the invention includes an air inlet and an air outlet and defines a plenum opening to and extending between the air inlet and the air outlet. A flow baffle is disposed within the plenum to divide the plenum into a first flow passage and a second flow passage, the second flow passage having an inlet interfacing in flow communication with an outlet of the first flow passage. The first flow passage is in flow communication with the air inlet to the plenum and the second flow passage is in flow communication with the air outlet of the plenum. An air mover operatively associated with the air curtain admission assembly directs air from externally of the housing through the air inlet to the plenum, thence through the first flow passage, thence through the second flow passage and out of the air outlet to pass generally across an opening located externally adjacent the outlet to the air curtain admission assembly. In accord with the invention, the flow of air through the plenum substantially reverses direction when passing from the first flow passage to the second flow passage. A perforated flow baffle may be disposed in the plenum at the interface of the outlet of the first flow passage with the inlet of the second flow passage. A perforated flow baffle may be disposed in the air outlet of said plenum. Either perforated flow baffle may be a slotted plate.

In a further embodiment of the air curtain admission assembly a third flow passage is established in the plenum beneath a forward end of the second flow passage whereby the air flow passing through the second flow passage turns through an angle of at least 90 degrees when passing from the second flow passage into the third flow passage. In this embodiment, the third flow passage in flow communication with the air outlet of the plenum. A second flow baffle having a flow blocking portion may be disposed in the plenum to establish the third flow passage and cause the air flowing from the second flow passage into the third flow passage to substantially reverse flow direction. The second flow baffle may include a perforated member through which air flow must pass into the third flow passage. In an embodiment, the perforated member is an egg-crate member defining a plurality of flow channels through which air flow may pass to enter the third flow passage.

In a further aspect of the invention, a refrigerated merchandiser is provided equipped with an improved air admission assembly. In one embodiment, the refrigerated merchandiser of the present invention includes an improved curtain air admission assembly through which a generally uniform flow distribution is ensured in the ambient air curtain along the length of the open front viewing area of the display case. In a preferred embodiment, the curtain air admission assembly includes a housing having a top wall and a perimeter wall, an air inlet and an air outlet, and defines a plenum opening to and extending between said air inlet and said air outlet. A flow baffle divides the plenum into a first flow passage and a second flow passage, with the second flow passage having an inlet interfacing in flow communication with an outlet of the first flow passage. The air inlet to the plenum opens to the first flow passage and the air outlet of the plenum communicates in flow communication with the second flow passage. One or more air movers, operatively associated with the air curtain admission assembly, directs air from externally of through the air inlet of the plenum, thence through the first flow passage, thence through the second flow passage and out of the air outlet to the plenum generally downwardly across the open front viewing area of the product display region. The flow of air through the plenum substantially reverses direction when passing from the first flow passage to the second flow passage. This reversal of flow direction serves to distribute the air flow more uniformly along the length of the display case.

In a further aspect of the invention, a refrigerated merchandiser includes a housing defining a product display region having an opening providing access to the product display region and an air curtain admission assembly operatively associated with the housing. The air curtain admission assembly defines a plenum opening to and extending between the air inlet and the air outlet. A flow baffle is disposed within said plenum to divide the plenum into a first flow passage and a second flow passage. The second flow passage has an inlet interfacing in flow communication with an outlet of the first flow passage. The first flow passage opens in flow communication with the air inlet to the plenum and the second flow passage opens in flow communication with the air outlet of the plenum. An air mover operatively associated with said air curtain admission assembly directs air from externally of the air admission assembly through the air inlet to the plenum, thence through the first flow passage, thence through the second flow passage and out of the air outlet to the plenum generally across the opening to the product display region thereby establishing an air curtain across the opening. The flow of air through the plenum substantially reverses direction when passing from the first flow passage to the second flow passage. In a further embodiment, the refrigerated merchandiser includes an air curtain admission assembly having a third flow passage established in the plenum beneath a forward end of the second flow passage. The air flow passing through the second flow passage turns through an angle of at least 90 degrees when passing from the second flow passage into the third flow passage, thus creating an additional reversal in flow direction. In this embodiment, the third flow passage in flow communication with the air outlet of the plenum. In another embodiment of the refrigerated merchandiser, the housing of the merchandiser includes a first air outlet and a second air outlet. The first air outlet directs a flow of air along a first path generally across the opening to the product display region. The second air outlet communicates in flow communication with the outlet of the air admission assembly plenum and directs air passing out of the plenum along a second path generally across the opening. The first and second paths may be parallel or may diverge.

DETAILED DESCRIPTION

Figure 1:
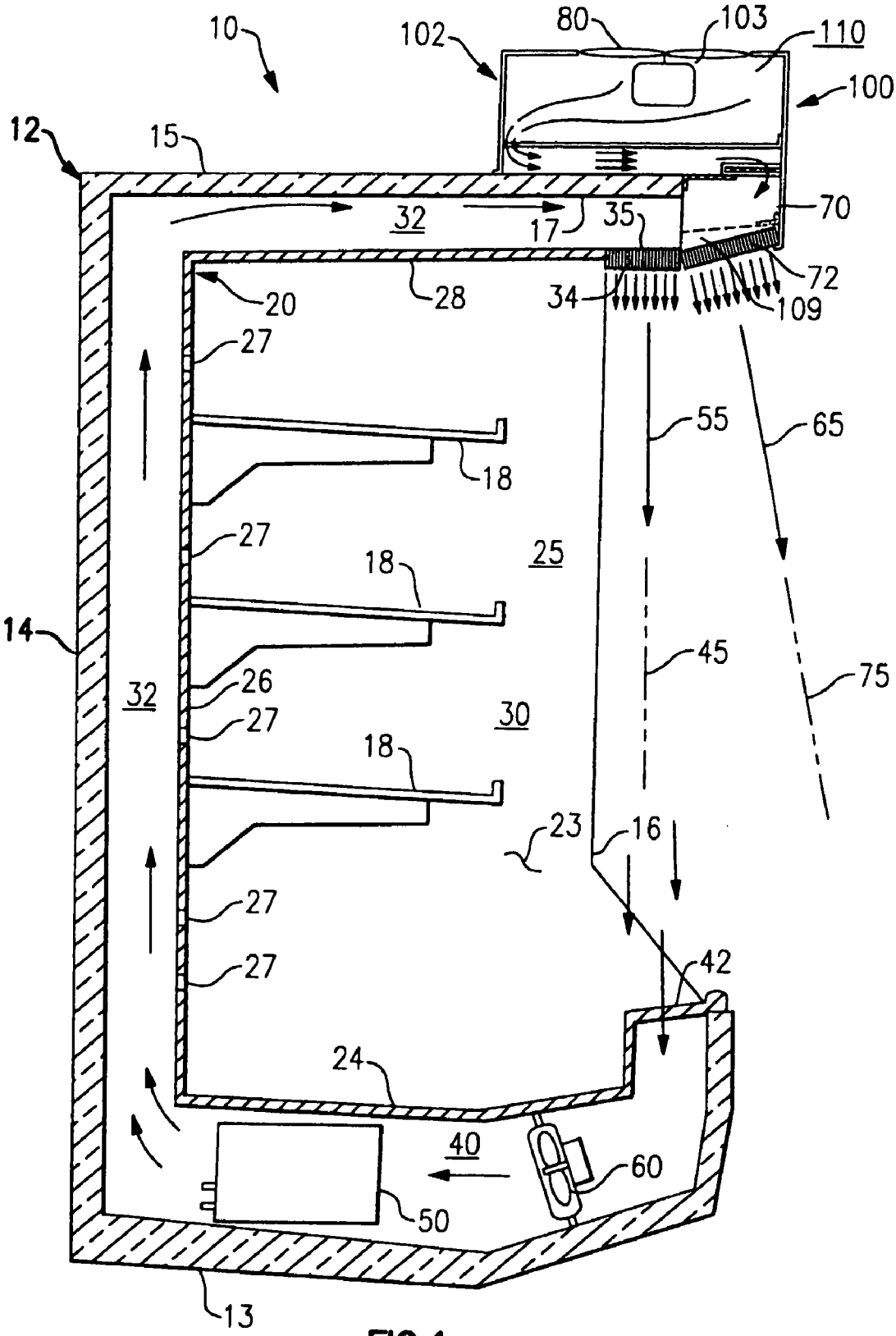
FIG. 1 illustrates a side elevation profile of a refrigerated merchandiser equipped with the improved air curtain admission assembly of the present invention.

Referring now to FIG. 1, the refrigerated merchandiser 10 includes an outer cabinet 12 and an inner cabinet liner 20 that defines within its bounds an open-front product display region 30. The outer cabinet has a base 13, a rear wall 14 extending upwardly from the back of the base 13, a top wall 15 extending forwardly from the rear wall and a pair of spaced side walls 16 extending vertically from the base 13 to the top wall 15 and forwardly from the rear wall 14. The inner cabinet liner 20 has a top panel 28, a back panel 26, a bottom panel 24 and opposed side panels 23 which together bound the open-front product display region 30. Each of the cabinet base 13, rear wall 14, top wall 15 and side walls 16 is insulated, as in conventional practice, to thermally isolate the interior of the cabinet 12, including the product display region 30, from excessive heat transfer therethrough.

Perishable product being merchandized may be displayed on shelves 18 disposed within the product display region 30 and upon the upper surface of the bottom panel 24. The product display region 30 has an open front 25 so as to permit consumers to not only view product, but also reach into the product display region 30 to select and remove items of product that they desire to purchase. Product display region 30 is cooled in a conventional manner to a desired product temperature, typically to a temperature between −10° F. to less than about 40° F., depending upon what product is being merchandised therein and whether the product is frozen or non-frozen.

The refrigerated merchandiser 10 further includes a refrigeration compartment 40, typically disposed in the portion of the display cabinet 12 between the base 13 and the bottom panel 24, as depicted in FIG. 1, wherein components of the refrigerant system, typically an evaporator 50 and an air mover 60, such as for example one or more axial fans, are housed. However, it is to be understood that the specific type of air mover employed is not relevant to or limiting of the present invention. The length of the refrigerated merchandiser 10 may vary from as little as 2 feet to 12 feet or greater. Further, the refrigerated merchandiser may be formed of a plurality of modules, each module being equipped with an evaporator 50 and one or more fans 60.

As in conventional practice, refrigerant passing through the tubes of the evaporator 50 cools air passing over the surface of the evaporator tubes under the influence of air mover 60. The refrigerant is typically supplied from a remote refrigeration unit located elsewhere within the store. However, it is to be understood that the present invention may also be employed on stand-alone refrigerated merchandisers that include their own refrigeration unit for providing the cold refrigerant.

An air circulation duct 32 is formed between the rear wall 14 and the top wall 15 of the outer cabinet 12 and the back panel 26 and top panel 28, respectively, of the inner cabinet liner 20. Air mover 60 serves to direct air from air inlet 42 through the compartment 40 so as to traverse evaporator 50, and thence through duct 32 to refrigerated air outlet 34. As noted before, this circulating air has been cooled to a desired temperature as it traverses the evaporator 50. From air outlet 34, the cool refrigeration air is directed via a gird of vanes 35 disposed within the air outlet 34 downwardly along first path 45 toward air inlet 42 to form an inner air curtain 55 across the open front 25 of the product display region 25. To converse energy expended in cooling the refrigeration air, the refrigerating air passing through the air inlet 42 is recycled and repeatedly recirculated through the compartment 40 and duct 32 back into and through the refrigerated product display region 30. Further, through the afore-described cooling arrangement, a cool air curtain 55 is formed across the open-front product display region 30 from top to bottom thereof. To provide further cooling air directly to the product display region 30, as in conventional practice, a plurality of openings 27 may be provided at selected locations in the back panel 26 through which a portion of cold refrigerating air circulating through duct 32 may pass directly into the product display region 30. This refrigerated air will also be drawn by the air mover 60 back through the air inlet 42 into the compartment 40 to be recirculated.

In the depicted refrigerated merchandiser 10, a second air outlet 70 is provided outwardly of the refrigerated air outlet 34 at the top front of the cabinet 12. The second air outlet 70 includes a gird of vanes 72 that serve to direct relatively warmer air, for example ambient air, generally downwardly along a second path 75 lying outwardly of the first path 45 followed by the cool refrigerating air. In this manner, a relatively warm outer air curtain 65 is formed outside, i.e. further away from the product display region 30, of the relatively cool inner air curtain 55. The relatively warm outer air curtain 65 serves as a buffer between the relatively cool inner air curtain 55 and the ambient environment of the store. Further, when the outer air curtain 65 reaches the base region of the display cabinet 12, it spills outwardly into the store rather than into the air inlet 42 in the forward end of the base portion of the cabinet. Consequently, the entrainment of warm air into the relatively cool inner air curtain and subsequent passage through inlet 42 into the compartment 40 is minimized, thereby reducing energy consumption in cooling the recirculating refrigeration air. The outer air curtain 65 may be directed, as in conventional practice, along a second path 75 that is generally parallel to the first path 45 along which the inner air curtain 55 is directed. Alternatively, the outer curtain 65 may be directed along a second path 75 that diverges outwardly away from the first path 45, along which the inner air curtain 55 is directed, at an angle of diverge within a desired range, such as, for example, within the range of about 5 degrees to about 50 degrees, as disclosed in commonly assigned, U.S. Pat. No. 6,722,149, to Saroka et al., the entire disclosure of which is hereby incorporated by reference. It is to be understood, however, that the angular relationship between the first and second paths is a matter of choice and not limiting of the application of the curtain air admission assembly of the present invention.

Figure 2:
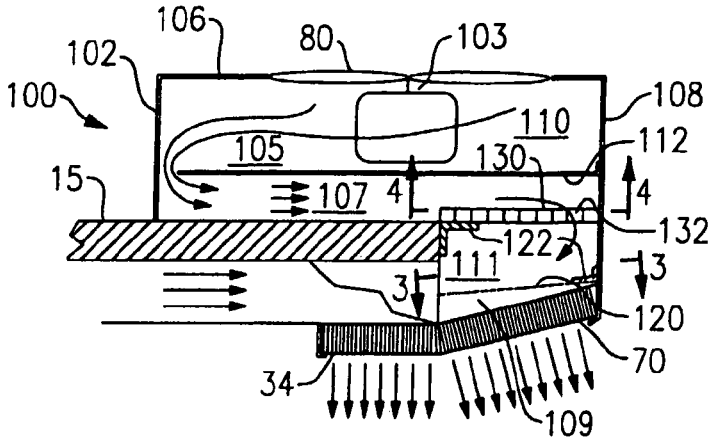
FIG. 2 is an enlarged side elevation view of the embodiment of the air curtain admission assembly depicted in FIG. 1.
Figure 5:
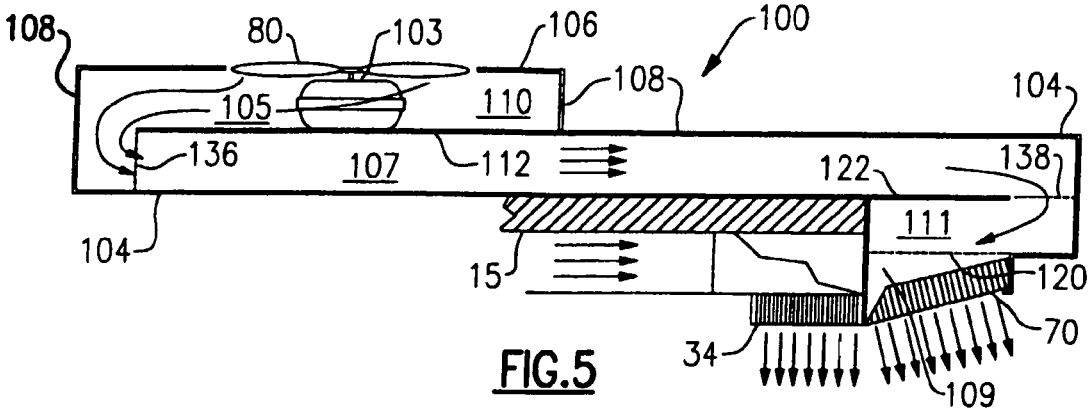
FIG. 5 is a side elevation view of an alternate embodiment of the air curtain admission assembly of the present invention.

The curtain air admission assembly 100 of the present invention comprises a housing 102 disposed atop the refrigerated merchandiser 10. The housing 102 may preferably be mounted to the top wall 15 of the refrigerated merchandiser 10 with the forward portion of the housing 102 extending beyond the forward end 17 of the top wall 15 of the merchandiser 10. Referring now in particular to FIGS. 2 and 5, the housing 102 has a top wall 106 and a perimeter wall 108 defining a plenum 110. The embodiment shown in FIG. 2 includes a compact, relatively short plenum, while the embodiment in FIG. 5 includes an elongated plenum. The embodiment shown in FIG. 2 is particularly useful in applications wherein the top wall 15 of the refrigerated merchandiser must serve as a surface upon which workers may occasionally walk. In either embodiment, the housing 102 may be mounted directly to the top wall 15 of the refrigerated merchandiser 10 in a conventional manner, for example through edge flanges extending from the perimeter wall 108 adapted to be screwed or otherwise secured to the refrigerated merchandiser. Alternatively, the housing 102 may further include a floor panel 104 supporting the perimeter wall 108 with the floor panel being adapted to be screwed or otherwise secured to the refrigerated merchandiser. This latter construction would be particularly useful for a curtain air admission assembly to be provided as a discrete unit for use in retrofit applications, while the former construction would more likely be used when the curtain air admission assembly is an integral part of an original equipment refrigerated merchandiser.

In either construction, a flow baffle 112 is disposed within the plenum 110 to partition the plenum 110 into a first flow passage 105 and a second flow passage 107. The housing 102 further includes an air inlet 103 opening to the plenum 110 through which air from externally of the housing 102 may pass into the plenum 110 and also an air outlet 109 from the plenum 110 through which air may pass from the plenum. The first flow passage 105 is in flow communication at its inlet end with the air inlet 103 and the second flow passage 107 is in flow communication at its outlet end with the air outlet 109. Further, the first air flow passage 105 has its outlet interfacing in fluid communication with the inlet of the second flow passage 107.

An air mover 80, operatively associated with the curtain air admission assembly 100, directs air from externally of the plenum 110 through the air inlet 103 of the plenum, thence through the first flow passage 105, thence through the second flow passage 107 and out of the air outlet 109 to the plenum 110 to discharge through the second air outlet 70 generally downwardly across the open front viewing area of the product display region 30. The air mover 80 may comprise one or more axial fans, as depicted in the drawings, depending upon the overall length of the refrigerated merchandiser 10. For example, in a refrigerated merchandiser having a length of twelve feet, the air mover 80 might comprise four fans disposed along the length of the refrigerated merchandiser 10 at spaced intervals. Advantageously, each air mover 80 may be a fan mounted in the air inlet 103 to the plenum 110 driven by a motor disposed within the plenum 110. However, the air mover 80 may be located externally of the plenum 110, for example upstream of the air inlet 103 in a duct supplying air to the plenum from a remote source. The air inlet 103 to the plenum 110 may be provided in the top wall 106 of the housing 102, as depicted in the drawings, or the air inlet 103 to the plenum 110 may be provided in a forward portion of the partition wall 108 so long as the air inlet 103 opens into the plenum 110.

As illustrated in FIGS. 2 and 5, the flow of air through the plenum 110 substantially reverses direction when passing from the first flow passage 105 to the second flow passage 107. Further, a second flow baffle 122 may be disposed in the second flow passage 107 in the forward portion of the plenum 110 to establish a third flow passageway 111 beneath the forward portion of the second flow passage 107. The second flow baffle 122 further serves to partially block flow from the second flow passageway 107 into the third flow passageway 111 in such a manner as to cause the air flowing from the second flow passageway into the third flow passageway to again substantially reverse flow direction. Each of the aforenoted reversals of direction serves to distribute the curtain air flow more uniformly along the length of the refrigerated merchandiser 10.

Figure 3:
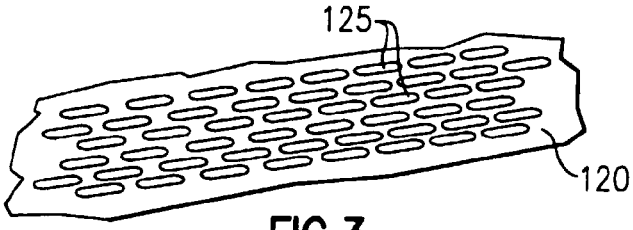
FIG. 3 is a side elevation view taken along line 3-3 of FIG. 2.

Referring now to FIGS. 2 and 5, a perforated plate 120 may be disposed across the air outlet 109 from the plenum 110. Advantageously, the perforated plate may comprise a slotted plate having a plurality of slot-shaped holes 125 therethrough arrayed in rows, for example such as shown in FIG. 3. The distribution of the air passing through the holes 125 in the perforated plate 120 may be selectively controlled or altered by limiting the holes 125 to a selected portion of the plate, by skewing the distribution of the holes over the area of the plate, or blocking flow through selected holes, such as, for example, by means of a flow blocking plate 122 disposed adjacent to the perforated plate 120 as illustrated in FIG. 2, which thus serves as a flow baffle.

Figure 4:
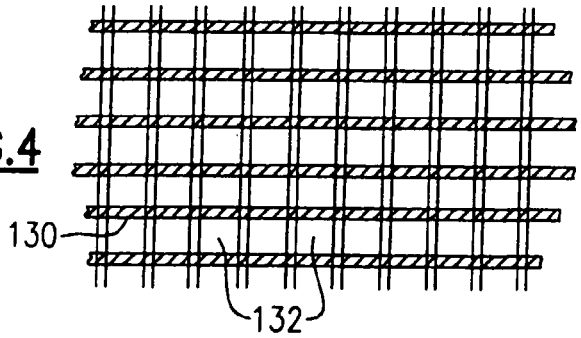
FIG. 4 is a side elevation view taken along line 4-4 of FIG. 2.

Referring now to FIGS. 2 and 4, an egg-crate member 130 defining a plurality of flow channels 132 may be disposed across the interface between the second flow passageway 107 and the third flow passageway 111. The flow channels 132 in the egg-crate member 130 serve to effect the desired change in flow direction as the air flow passes from the second flow passageway 107 into the third flow passage 111. By adjusting the distance that the second flow baffle 122 extends across the interface between the second flow passageway 107 and the third flow passageway 111, the distribution of the air flowing from the second flow passageway 107 to the third flow passageway 111 via the flow channels 132 may be selectively altered as desired.

Referring now to FIG. 5, a perforated plate 136 may be disposed at the interface of the first flow passageway 105 and the second flow passageway 107 to further effect a uniform distribution of the air passing therethrough along the length of the refrigerated merchandiser. Advantageously, the perforated plate 136 may comprise a slotted plate having a plurality of slot-shaped holes therethrough arrayed in rows, for example similar to plate 120 shown in FIG. 3. Further, a perforated member 138 may be disposed at the interface between the second flow passageway 107 and the third flow passageway 111. The perforated member 138 may simply be integral with and an extension of the second flow baffle 122. Alternatively, the perforate member 138 may comprise a separate, slotted plate having a plurality of slot-shaped holes therethrough arrayed in rows, for example similar to plate 120 shown in FIG. 3, disposed as an extension of the second flow baffle 122.

It is to be understood that the aforementioned description is exemplary rather than limiting. Many modifications and variations of the present invention may be recognized by those skilled in the art in light of the above teachings that will fall within the spirit and scope of the present invention. Although the curtain air admission assembly has been disclosed in a preferred embodiment in connection with a refrigerated merchandiser, those skilled in the art may recognize other applications for the curtain air admission assembly of the present invention. Accordingly, within the scope of the appended claims, the invention may be practiced otherwise than as specifically described without departing from the scope and spirit of the present invention as set forth in the following claims.

The invention claimed is:

1. A refrigerated merchandiser comprising: a first housing defining a product display region having an open-front viewing area, said first housing having a first top wall; an air curtain admission assembly operatively associated with said first housing, said air curtain admission assembly including a second housing disposed above said first top wall of said first housing, said second housing having a second top wall and a perimeter wall, an air inlet and an air outlet, said second housing defining a plenum opening to and extending between said air inlet and said air outlet; a flow baffle disposed within said plenum and above said first top wall of said first housing, said flow baffle dividing said plenum into a first flow passage and a second flow passage above said first top wall of said first housing, said second flow passage having an inlet interfacing in flow communication with an outlet of said first flow passage, said first flow passage in flow communication with the air inlet to said plenum and said second flow passage in flow communication with the air outlet of said plenum; and an air mover operatively associated with said air curtain admission assembly, the air mover operative to direct air from externally of said second housing through the air inlet to said plenum, thence through said first flow passage, thence through said second flow passage and out of the air outlet to said plenum generally across the open front viewing area of the product display region, the flow of air through said plenum substantially reversing direction when passing from said first flow passage to said second flow passage; —further comprising a second flow baffle disposed in said plenum and establishing a third flow passage in said plenum beneath a forward end of the second flow passage whereby the air flow passing through the second flow passage turns through an angle of at least 90 degrees when passing from the second flow passage into the third flow passage, the third flow passage in flow communication with the air outlet of the plenum.

2. A refrigerated merchandiser as recited in claim 1 further comprising a perforated flow baffle disposed in said plenum at the interface of the outlet of said first flow passage with the inlet of said second flow passage.

3. A refrigerated merchandiser as recited in claim 2 wherein said perforated flow baffle comprises a slotted plate.

4. A refrigerated merchandiser as recited in claim 1 further comprising a perforated flow baffle disposed in the air outlet of said plenum.

5. A refrigerated merchandiser as recited in claim 4 wherein said perforated flow baffle comprises a slotted plate.

6. A refrigerated merchandiser as recited in claim 1 further comprising a second flow baffle disposed in said plenum and establishing a third flow passage in said plenum beneath a forward end of said second flow passage whereby the air flow passing through said second flow passage turns through an angle of at least 90 degrees when passing from said second flow passage into said third flow passage, said third flow passage in flow communication with the air outlet of said plenum.

7. A refrigerated merchandiser as recited in claim 1 wherein said second flow baffle comprises a plate having a flow blocking rearward portion and a perforated forward portion through which air flow may pass into said third flow passage.

8. A refrigerated merchandiser as recited in claim 1 wherein said second flow baffle comprises an egg-crate member defining a plurality of flow channels through which air flow may pass into said third flow passage.

9. A refrigerated merchandiser as recited in claim 8 wherein the flow channels in a rearward portion of the egg-crate member are blocked so as to preclude air flow therethrough.

10. An air curtain admission assembly operatively associated with an opening for establishing an air curtain across the opening, said air curtain admission assembly comprising:

a housing having a top wall and a perimeter wall, an air inlet and an air outlet, said housing defining a plenum opening to and extending between said air inlet and said air outlet;

a first flow baffle disposed within said plenum and dividing said plenum into a first flow passage and a second flow passage, said second flow passage having an inlet interfacing in flow communication with an outlet of said first flow passage, said first flow passage in flow communication with the air inlet to said plenum and said second flow passage in flow communication with the air outlet of said plenum; and an air mover operative to direct air from externally of said housing through the air inlet to said plenum, thence through said first flow passage, thence through said second flow passage and out of the air outlet to said plenum generally across the opening, the flow of air through said plenum substantially reversing direction when passing from said first flow passage to said second flow passage; and a second flow baffle disposed in said plenum and establishing a third flow passage in said plenum beneath a forward end of said second flow passage, said third flow passage in flow communication with said second flow passage and the air outlet of said plenum, the flow of air through said plenum substantially reversing direction when passing from said second flow passage to said first flow passage.

11. An air curtain admission assembly as recited in claim 10 further comprising a perforated flow baffle disposed in said plenum at the interface of the outlet of said first flow passage with the inlet of said second flow passage.

12. An air curtain admission assembly as recited in claim 11 wherein said perforated flow baffle comprises a slotted plate.

13. An air curtain admission assembly as recited in claim 10 further comprising a perforated flow baffle disposed in the air outlet of said plenum.

14. An air curtain admission assembly as recited in claim 13 wherein said perforated flow baffle comprises a slotted plate.

15. An air cuff am admission assembly as recited in claim 10 wherein said second flow baffle causes the air flow passing through said second flow passage to turn through an angle of at least 90 degrees when passing from said second flow passage into said third flow passage.

16. An air cuff am admission assembly as recited in claim 15 wherein said second flow baffle comprises a plate having a flow blocking rearward portion and a perforated forward portion through which air flow may pass into said third flow passage.

17. An air cuff am admission assembly as recited in claim 16 wherein said second flow baffle comprises an egg-crate member defining a plurality of flow channels through which air flow may pass into said third flow passage and wherein the flow channels in a rearward portion of the egg-crate member are blocked so as to preclude air flow therethrough.

18. A refrigerated merchandiser comprising:

a housing defining a product display region having an opening providing access to the product display region;

an air curtain admission assembly operatively associated with said housing, said air curtain admission assembly defining a plenum opening to and extending between an air inlet and an air outlet;

a flow baffle disposed within said plenum and dividing said plenum into a first flow passage and a second flow passage, said second flow passage having an inlet interfacing in flow communication with an outlet of said first flow passage, said first flow passage in flow communication with the air inlet to said plenum and said second flow passage in flow communication with the air outlet of said plenum; and an air mover operatively associated with said air curtain admission assembly, the air mover operative to direct air from externally of said housing through the air inlet to said plenum, thence through said first flow passage, thence through said second flow passage and out of the air outlet to said plenum generally across the opening to the product display region, the flow of air through said plenum substantially reversing direction when passing from said first flow passage to said second flow passage; and a second flow baffle disposed in said plenum and establishing a third flow passage in said plenum beneath a forward end of said second flow passage whereby the air flow passing through said second flow passage turns through an angle of at least 90 degrees when passing from said second flow passage into said third flow passage, said third flow passage in flow communication with the air outlet of said plenum.

19. A refrigerated merchandiser as recited in claim 18 further comprising a perforated flow baffle disposed in said plenum at the interface of the outlet of said first flow passage with the inlet of said second flow passage.

20. A refrigerated merchandiser as recited in claim 19 wherein said perforated flow baffle comprises a slotted plate.

21. A refrigerated merchandiser as recited in claim 18 further comprising a perforated flow baffle disposed in the air outlet of said plenum.

22. A refrigerated merchandiser as recited in claim 21 wherein said perforated flow baffle comprises a slotted plate.

23. A refrigerated merchandiser as recited in claim 18 wherein said second flow baffle comprises a plate having a flow blocking rearward portion and a perforated forward portion through which air flow may pass into said third flow passage.

24. A refrigerated merchandiser as recited in claim 18 wherein said second flow baffle comprises an egg-crate member defining a plurality of flow channels through which air flow may pass into said third flow passage.

25. A refrigerated merchandiser as recited in claim 24 wherein the flow channels in a rearward portion of the egg-crate member are blocked so as to preclude air flow therethrough.

26. A refrigerated merchandiser as recited in claim 18 wherein said housing includes a first air outlet and a second air outlet, said first air outlet directing a flow of air along a first path generally across the opening to the product display region, and said second air outlet being in flow communication with the outlet of said plenum and directing air passing out of said plenum along a second path generally across the opening.

27. A refrigerated merchandiser as recited in claim 26 wherein said second air outlet directs air passing out of said plenum along a second path generally across the opening in divergent relationship to the first path.

* * * * *